United States Patent [19]

Schuster et al.

[11] Patent Number: 4,643,739

[45] Date of Patent: Feb. 17, 1987

[54] FUEL DISTRIBUTOR IN A REACTOR FOR GASIFYING SOLID GRANULAR FUELS

[75] Inventors: Gert Schuster, Neu Anspach; Helmut Vierrath, Neu-Isenburg; Hans Küpfer, Frankfurt am Main; Heinz Wolf, Bad Nauheim, all of Fed. Rep. of Germany

[73] Assignee: Metallgesellschaft Aktiengesellschaft, Frankfurt am Main, Fed. Rep. of Germany

[21] Appl. No.: 792,811

[22] Filed: Oct. 30, 1985

[30] Foreign Application Priority Data

Nov. 7, 1984 [DE] Fed. Rep. of Germany ..... 3440618

[51] Int. Cl.[4] ..... C10J 3/30

[52] U.S. Cl. ..... 48/86 R; 48/73; 48/77; 414/160; 414/195

[58] Field of Search ..... 48/73, 63, 64, 86 R, 48/77; 414/160, 195, 199, 205, 206, 301, 588

[56] References Cited

U.S. PATENT DOCUMENTS

| | | | |
|---|---|---|---|
| 2,925,334 | 2/1960 | Henze et al. | 48/86 R |
| 3,540,867 | 11/1970 | Baron et al. . | |
| 3,854,895 | 12/1974 | Muller et al. . | |
| 3,902,872 | 9/1975 | Rudolph . | |
| 4,040,800 | 8/1977 | Rudolph et al. | 48/86 R |
| 4,405,340 | 9/1983 | Küpfer et al. . | |

FOREIGN PATENT DOCUMENTS

| | | |
|---|---|---|
| 2352900 | 11/1975 | Fed. Rep. of Germany . |
| 3032949 | 4/1982 | Fed. Rep. of Germany . |
| 1507905 | 4/1978 | United Kingdom . |
| 1508671 | 4/1978 | United Kingdom . |
| 1512677 | 6/1978 | United Kingdom . |

OTHER PUBLICATIONS

West German Publication, "Ullmanns Encyklopädie der Technischen Chemie"-cover page and article (pp. 383-386).

*Primary Examiner*—Peter Kratz

*Attorney, Agent, or Firm*—Karl F. Ross; Herbert Dubno

[57] ABSTRACT

The reactor for the gasification of the fuel in a fixed bed comprises a rotary distributor, which is disposed over the fixed bed and includes at least one outlet structure for the fuel. The outlet structure consists of a tube, which is formed at its lower end with two arcuate cutouts through which the fuel flows out approximately at right angles to the direction of movement of the tube. Each cutout lies in a plane which includes an angle of about 25° to 50° with the horizontal. The outlet end of the tube has preferably the same elevation on the leading and trailing sides of the tube.

4 Claims, 3 Drawing Figures

Fig.1
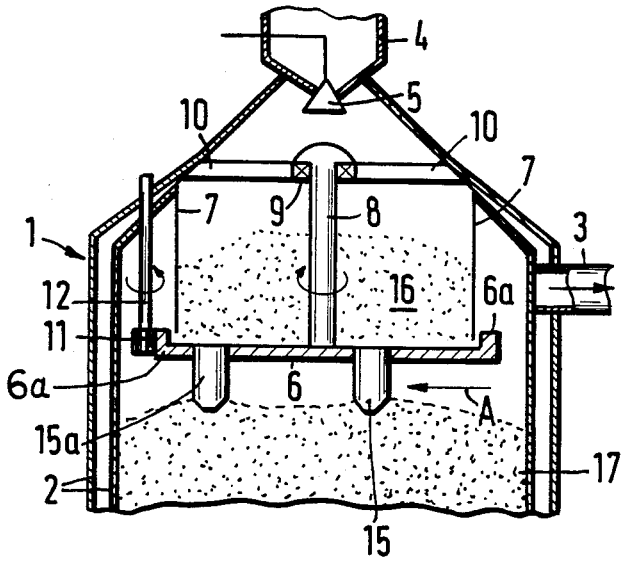
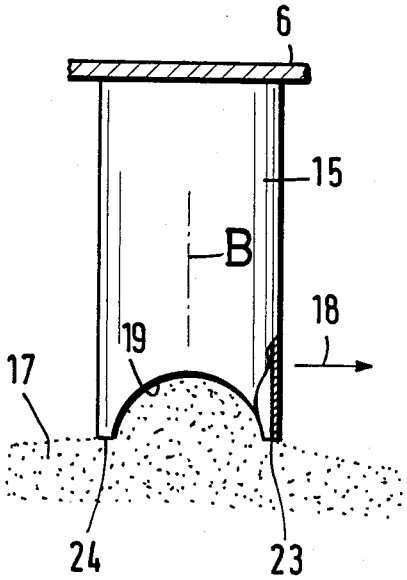
Fig.2
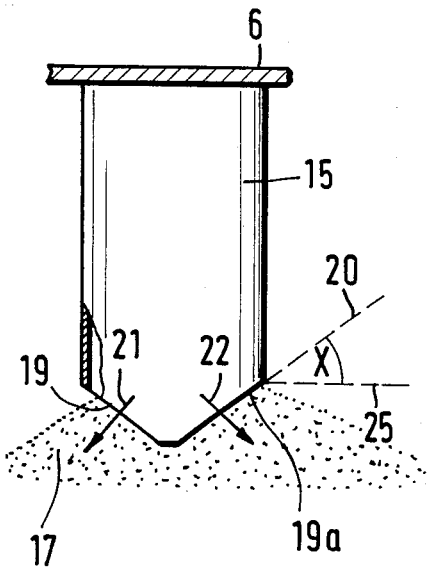
Fig.3

FUEL DISTRIBUTOR IN A REACTOR FOR GASIFYING SOLID GRANULAR FUELS

FIELD OF THE INVENTION

Our present invention relates to a fuel distributor in a solid-fuel gasifier and, more particularly, to a fuel distributor for a reactor of the gasification of solid, generally granular fuels lying in a bed to which the fuel is added from above.

BACKGROUND OF THE INVENTION

In U.S. Pat. Nos. 3,902,972 and 4,405,340, there is described a reactor for gasifying solid granular fuels having particle sizes in the range from about 2 to about 80 mm under a pressure of 5 to 150 bars by a treatment with gasifying agents containing oxygen, water vapor and/or carbon dioxide.

The fuels constitute in the reactor a fixed bed, which descends slowly and into which the gasifying agents are introduced from below and from the lower end of which the incombustible mineral constituents of the fuels are withdrawn as solid ash or liquid slag.

The reactor comprises a rotary distributor, which is disposed above the fixed bed and has at least one fuel outlet structure that is directed toward the fixed bed. A lock chamber, which is disposed above the distributor, serves to deliver fuel to the distributor.

The gasification of solid fuels, particularly of hard coal or brown coal (lignite), is known and has been described, e.g. in Ullmanns Enzyklopadie der technischen Chemie, 4th edition (1977), on pages 383 to 386 of volume 14.

Details of a gasifying process involving solid ash are given in U.S. Pat. Nos. 3,540,967 and 3,854,895.

The process involving a withdrawal of liquid slag has been explained in British patent specifications Nos. 1,507,905; 1,508,671; and 1,512,677.

German patent specification No. 2,352,900 and published German application No. 30 32 949 and the corresponding U.S. Pat. Nos. 3,902,872 and 4,405,340, respectively, as noted above describe the gasification reactors provided with fuel distributors of the kind described hereinbefore.

These distributors have fuel discharge ducts having a leading portion (in the direction of displacement) which is disposed slightly below the trailing portion. In such an arrangement the leading portion of the duct may plow through the fuel that has been deposited on the fixed bed and may push some of the fuel aside if the descent of the fixed bed has been interrupted by some disturbance.

If the descent of the fixed bed of fuel has been interrupted by such disturbance and the fuel is pushed aside as described hereinbefore, new fuel can continuously flow onto the fixed bed so that the reactor will be charged with undesirably large quantities of fresh fuel in spite of the prolonged interruption of the gasification process.

OBJECTS OF THE INVENTION

It is the principal object of the present invention to provide an improved fuel distributor which obviates the above-mentioned disadvantages.

Another object of the invention is to provide an improved reactor in which disturbance of descent of the bed does not cause an uncontrolled flow of granular fuel into the reactor.

It is yet another object of the invention to provide the fuel distributor with an outlet structure which is so designed that an undisturbed supply of fresh fuel onto the fixed bed will be ensured during a normal gasification operation and that a flow of an undesirably large quantity of fresh fuel from the distributor onto the fixed bed will be prevented when the descent of the fixed bed has been interrupted.

SUMMARY OF THE INVENTION

These objects and others which will become apparent hereinafter are attained in an improved distributor for a reactor for gasifying fuels having a particle size of about 2 to about 80 mm under a pressure of 5 to 150 bars using, as gasification agents one or more oxygen carriers selected from the group which consists of $O_2$, $H_2O$ and $CO_2$, and wherein the reactor construction, apart from the improved distributor can be as described.

In accordance with the invention the fuel outlet structure consists of a tube having an outlet end portion that is provided on opposite sides with respective arcuate cutouts spaced apart at right angles to the direction of movement of the tube and permitting the fuel to flow through said cutouts approximately at right angles to the direction of movement of the tube.

In the prior-art discharge duct (without these lateral cutouts), the fuel flows out preferentially near the trailing end of the discharge passage when the fixed bed is not descending owing to a disturbance and this has resulted in the difficulties mentioned above.

Preferably each of the two cutouts provided at the outlet end lies in a plane which includes with the horizontal an angle X of about 25 to 50 degrees and preferably of 30 to 45 degrees.

The angle is preferably smaller than the angle of repose of the bulk material. In a preferred arrangement the outlet end of the tube has approximately the same elevation on its leading and trailing sides. This ensures that in case of an interruption of the descent of the fixed bed of fuel the continued rotation of the fuel distributor will not result in a continued supply of fuel to the fixed bed.

Advantageously, the two cutouts are approximately symmetrical to the center or median plane of the tube, which center plane is vertical and at right angles to the direction of movement of the tube.

Investigations have also shown that the height of the tube should be at least twice the tube diameter and should not exceed about four times that diameter so that a normal flow of fuel out of the tube will be ensured during normal operation without a danger of a caking in the tube.

BRIEF DESCRIPTION OF THE DRAWING

The above and other objects, features and advantages of the present invention will become more readily apparent from the following description, reference being made to the accompanying drawing in which:

FIG. 1 is a diagrammatic longitudinal sectional view showing the top portion of the gasification reactor with the fuel distributor of the invention;

FIG. 2 is an enlarged elevation, partly broken away, showing a fuel discharge structure of this reactor viewed in the direction of the arrow II in FIG. 1; and FIG. 3 is an elevation, partly broken away, taken at right angles to that of FIG. 2 and showing the discharge tube viewed in a direction which is at right angles to the direction of view of FIG. 2, i.e., opposite to the direction of movement of the tube.

SPECIFIC DESCRIPTION

The gasification reactor 1 comprises a water-cooled jacketed shell 2, a product gas outlet 3 and, at its top end, a lock chamber 4 for charging fuel.

When the valve 5 is open, fresh fuel flows into the reactor 1 to reach first the rotatable fuel distributor 6, in which the body of bulk material is confined by a stationary cylindrical wall 7.

The distributor 6 is suspended from a central rotary shaft 8, which is rotatably mounted on a bearing ring 9. The bearing ring 9 is connected by several struts 10 to the housing of the reactor 1. Rotation is imparted to the distributor 6 by a pinion 11, which is operatively connected by a shaft 12 to a motor, not shown, which is disposed outside the reactor. The pinion 11 is in mesh with a gear that is carried by the disclike distributor 6 at the outer edge thereof.

The distributor 6 comprises two discharge tubes 15 and 15*a*. One tube may be sufficient or more discharge tubes may be provided in case of need. The granular fuel forms a body of bulk material 16 above the distributor 6 and during a rotation of the latter flows downwardly onto the fixed bed 17 through the valveless tubes 15 and 15*a*. Only the uppermost portion of the fixed bed is shown here. The gasifying agents are passed through the fixed bed in known manner from bottom to top. Product gas leaves the reactor through the outlet 3. Details of the reactor have been omitted in the drawing for the sake of simplicity.

An enlarged elevation of the discharge tube 15 is shown in FIGS. 2 and 3. In FIG. 2 the view is taken in the direction of the arrow A in FIG. 2. In FIG. 3 the view is taken at right angles to the direction of view in FIG. 1, i.e. opposite to the direction in which the tube is moved by the rotating distributor 6; that direction of movement is indicated in FIG. 2 by the arrow 18.

FIG. 2 shows an arcuate cutout 19 formed at the lower end of the tube 15. That arcuate cutout may be imagined to have been formed by a cut in an inclined plane, e.g. in the plane 20 indicated by a broken line in FIG. 3.

The outlet end of the tube 15 has two such cutouts 19 and 19*a*, which are shown in FIG. 3.

When the distributor 6 is rotated to move each tube 15 or 15*a* in the direction of the arrow 18 in FIG. 2, the granular fuels flows out of the tube on both sides thereof in a downward and lateral directions, as is indicated in FIG. 3 by the arrows 21 and 22.

For the optimum operation of the discharge tube 15 or 15*a* it is important that the leading portion 23 and the trailing portion 24 of the outlet of the tube are on the same level and that the entire outlet region is approximately symmetrical with respect to the median plane B indicated in phantom in FIG. 2. The larger the deviation from that symmetry with respect to the center plane B, the greater will be the tendency of the discharge end moving in the direction of the arrow 18 to push aside the fuel that has been deposited on the fixed bed 17 during the preceding revolution of the distributor 6 and thus to provide a free space for a flow of fresh fuel even though the fixed bed may not have descended in the meantime.

As has been explained hereinbefore, this effect is not desired and may result in an overcharging of the reactor when the gasification in the reactor has been interrupted for a prolonged time by a disturbance.

FIG. 3 shows the plane 20 in which the cutout 19 extends. That plane includes an angle X with the horizontal plane 25. The angle X lies usually in the range from 25 to 50 degrees. The two cutouts 19 and 19*a* of a tube may extend in planes at different angles X. The overall height of the tube 15 is preferably at least twice the diameter of the tube and usually does not exceed four times that diameter. This will ensure that a caking in the tube 15 will also be prevented as far as possible also during normal operation.

We claim:

1. In a reactor for gasifying solid granular fuels having particle sizes in the range from about 2 to about 80 mm under a pressure of 5 to 150 bars by a treatment with gasifying agents containing oxygen, water vapor and/or carbon dioxide, wherein the fuels constitute in the reactor a slowly descending fixed bed, into which the gasifying agents are introduced from below and from the lower end of which the incombustible mineral constituents of the fuels are withdrawn, which reactor comprises a rotary distributor disposed above the fixed bed and has at least one fuel outlet structure that is directed toward the fixed bed, and which reactor also comprises a lock chamber disposed above the distributor and serves to deliver fuel to the distributor, the improvement wherein the fuel outlet structure consists of a tube having an outlet end portion that is provided on opposite sides with respective arcuate cutouts spaced apart at a right angle to the direction of rotation of the tube and permitting the fuel to flow through said cutouts approximately at a right angle to the direction of movement of the tube, and the outlet end of the tube has approximately the same elevation on its leading and trailing sides and the outlet end portion is approximately symmetrical to a vertical median plane of the tube at a right angle to the direction of movement of the tube.

2. The improvement defined in claim 1 wherein the cutouts lie each in a plane which includes with the horizontal an angle X of about 25° to 50°.

3. The improvement defined in claim 1 wherein the height of the tube is at least twice its diameter.

4. The improvement defined in claim 2 wherein the height of the tube is at least twice its diameter.

* * * * *